US009941068B2

(12) United States Patent
Liu

(10) Patent No.: US 9,941,068 B2
(45) Date of Patent: Apr. 10, 2018

(54) KEY STRUCTURE

(71) Applicant: Primax Electronics Ltd., Neihu, Taipei (TW)

(72) Inventor: Chien-Hung Liu, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 9 days.

(21) Appl. No.: 15/157,177

(22) Filed: May 17, 2016

(65) Prior Publication Data

US 2017/0294276 A1 Oct. 12, 2017

(30) Foreign Application Priority Data

Apr. 8, 2016 (TW) ..... 105111072 A

(51) Int. Cl.
*H01H 13/14* (2006.01)
*H01H 13/84* (2006.01)

(52) U.S. Cl.
CPC ..... *H01H 13/14* (2013.01); *H01H 13/84* (2013.01); *H01H 2215/03* (2013.01); *H01H 2227/036* (2013.01); *H01H 2239/022* (2013.01)

(58) Field of Classification Search
CPC ..... H01H 1/242; H01H 13/12; H01H 13/52; H01H 1/245; H01H 1/44; H01H 21/24; H01H 13/14; H01H 13/84; H01H 2239/022; H01H 2227/036; H01H 2215/03; H03K 17/962; H03K 2217/960755; H03K 17/975; H03K 17/9622; H03K 2217/96076
USPC .. 200/559, 532, 246, 16 C, 283, 276.1, 276, 200/535, 314, 341–345, 292, 293, 294, 200/5 A, 600
See application file for complete search history.

(56) References Cited

U.S. PATENT DOCUMENTS 4,972,056 A * 11/1990 Wu ..... H01H 13/52 200/276.1
5,586,645 A * 12/1996 Bartok ..... H01H 13/585 200/526
2009/0107816 A1* 4/2009 Chen ..... H01H 13/83 200/314
2017/0169967 A1* 6/2017 Chen ..... H01H 13/06

* cited by examiner

*Primary Examiner* — Ahmed Saeed
(74) *Attorney, Agent, or Firm* — Kirton McConkie; Evan R. Witt

(57) ABSTRACT

A key structure includes a pedestal with a sliding groove, an upper cover, a triggering element, and a spring strip. The spring strip is movable within the sliding groove. The triggering element is arranged between the pedestal and the upper cover, and located beside the spring strip. When a keycap of the key structure is depressed, the triggering element is moved relative to the pedestal to push the spring strip. In response to the elasticity of the pushed spring strip, the spring strip is slid within the sliding groove to collide with the upper cover. Consequently, the key structure generates sound surely.

12 Claims, 10 Drawing Sheets

KEY STRUCTURE

FIELD OF THE INVENTION

The present invention relates to a key structure, and more particularly to a mechanical key structure.

BACKGROUND OF THE INVENTION

Generally, the widely-used peripheral input device of a computer system includes for example a mouse, a keyboard, a trackball, or the like. Via the keyboard, characters or symbols can be directly inputted into the computer system. As a consequence, most users and most manufacturers of input devices pay much attention to the development of keyboards. As known, a keyboard with scissors-type connecting elements is one of the widely-used keyboards.

Hereinafter, a key structure with a scissors-type connecting element of a conventional keyboard will be illustrated with reference to FIG. 1. FIG. 1 is a schematic side cross-sectional view illustrating a conventional key structure. As shown in FIG. 1, the conventional key structure 1 comprises a keycap 11, a scissors-type connecting element 12, a rubbery elastomer 13, a membrane switch circuit member 14 and a base plate 15. The keycap 11, the scissors-type connecting element 12, the rubbery elastomer 13 and the membrane switch circuit member 14 are supported by the base plate 15. The scissors-type connecting element 12 is used for connecting the base plate 15 and the keycap 11.

The membrane switch circuit member 14 comprises plural key intersections (not shown). When one of the plural key intersections is triggered, a corresponding key signal is generated. The rubbery elastomer 13 is disposed on the membrane switch circuit member 14. Each rubbery elastomer 13 is aligned with a corresponding key intersection. When the rubbery elastomer 13 is depressed, the rubbery elastomer 13 is subjected to deformation to push the corresponding key intersection of the membrane switch circuit member 14. Consequently, the corresponding key signal is generated.

The scissors-type connecting element 12 is arranged between the base plate 15 and the keycap 11, and the base plate 15 and the keycap 11 are connected with each other through the scissors-type connecting element 12. The scissors-type connecting element 12 comprises a first frame 121 and a second frame 122. A first end of the first frame 121 is connected with the keycap 11. A second end of the first frame 121 is connected with the base plate 15. The rubbery elastomer 13 is enclosed by the scissors-type connecting element 12. Moreover, the first frame 121 comprises a first keycap post 1211 and a first base plate post 1212. The first frame 121 is connected with the keycap 11 through the first keycap post 1211. The first frame 121 is connected with the base plate 15 through the first base plate post 1212. The second frame 122 is combined with the first frame 121. A first end of the second frame 122 is connected with the base plate 15. A second end of the second frame 122 is connected with the keycap 11. Moreover, the second frame 122 comprises a second keycap post 1221 and a second base plate post 1222. The second frame 122 is connected with the keycap 11 through the second keycap post 1221. The second frame 122 is connected with the base plate 15 through the second base plate post 1222.

The operations of the conventional key structure 1 in response to the depressing action of the user will be illustrated as follows. Please refer to FIG. 1 again. When the keycap 11 is depressed, the keycap 11 is moved downwardly to push the scissors-type connecting element 12 in response to the depressing force. As the keycap 11 is moved downwardly relative to the base plate 15, the keycap 11 pushes the corresponding rubbery elastomer 13. At the same time, the rubbery elastomer 13 is subjected to deformation to push the membrane switch circuit member 14 and trigger the corresponding key intersection of the membrane switch circuit member 14. Consequently, the membrane switch circuit member 14 generates a corresponding key signal. When the keycap 11 is no longer depressed by the user, no external force is applied to the keycap 11 and the rubbery elastomer 13 is no longer pushed by the keycap 11. In response to the elasticity of the rubbery elastomer 13, the rubbery elastomer 13 is restored to its original shape to provide an upward elastic restoring force. Consequently, the keycap 11 is returned to its original position where it is not depressed.

With increasing development of science and technology, a mechanical key structure is introduced into the market. FIG. 2 is a schematic exploded view illustrating a conventional mechanical key structure. As shown in FIG. 2, the mechanical key structure 2 comprises a keycap (not shown), a pedestal 21, an upper cover 22, a push element 23, a linkage element 24, a first spring strip 25, a second spring strip 26 and a circuit board (not shown). The pedestal 21 is covered by the upper cover 22. The upper cover 22 has an opening 221. The linkage element 24 is located at a middle region of the pedestal 21. Moreover, the linkage element 24 is movable upwardly or downwardly relative to the pedestal 21. The first spring strip 25 is partially disposed within the pedestal 21, and located near a sidewall of the pedestal 21. The second spring strip 26 is partially disposed within the pedestal 21, and arranged between the linkage element 24 and the first spring strip 25. The push element 23 and the linkage element 24 are collaboratively disposed on the pedestal 21. The push element 23 is penetrated through the opening 221 and coupled with the keycap. Moreover, the first spring strip 25 and the second spring strip 26 are electrically connected with the circuit board.

Please refer to FIG. 2 again. The linkage element 24 has a protrusion structure 241. The protrusion structure 241 is extended from a sidewall of the linkage element 24 toward the first spring strip 25. Moreover, the first spring strip 25 comprises a fixing part 251 and an elastic part 252. The fixing part 251 is fixed on the pedestal 21. The elastic part 252 is extended from the fixing part 251. Moreover, the elastic part 252 is contacted with the protrusion structure 241 of the linkage element 24. Consequently, the elastic part 252 is movable relative to the fixing part 251.

When the keycap is depressed, the keycap is moved downwardly to push the push element 23. Consequently, the linkage element 24 connected with the push element 23 is moved downwardly. As the linkage element 24 is moved downwardly, the protrusion structure 241 of the linkage element 24 is contacted with the elastic part 252 and moved downwardly along the elastic part 252. While the linkage element 24 is quickly moved in response to the depressing force of the user, the linkage element 24 is quickly moved across the elastic part 252, and the elastic part 252 is pushed by the protrusion structure 241 of the linkage element 24. Consequently, the elastic part 252 is moved relative to the fixing part 251 to collide with the second spring strip 26. Since the first spring strip 25 and the second spring strip 26 are contacted with each other, the circuit board outputs a corresponding key signal. Moreover, while the first spring strip 25 and the second spring strip 26 are contacted with each other, a click sound is generated. Due to the click sound, the user can feel the depressing feedback.

Since the mechanical key structure 2 generates the click sound to provide the feedback feel while the keycap is depressed, the mechanical key structure 2 is favored by many users. However, the conventional mechanical key structure 2 still has some drawbacks. For example, since the push element 23 and the linkage element 24 are coupled with each other, the push element 23 should have a position-limiting structure to limit the movement of the linkage element 24. Under this circumstance, the thicknesses of the push element 23 and the linkage element 24 cannot be effectively reduced. Consequently, the volume of the mechanical key structure 2 cannot be effectively reduced.

Therefore, there is a need of providing a key structure with reduced volume.

SUMMARY OF THE INVENTION

The present invention provides a key structure with reduced volume.

In accordance with an aspect of the present invention, there is provided a key structure. The key structure includes a pedestal, an upper cover, a triggering element and a spring strip. The pedestal includes a sliding groove. The upper cover has an opening. The pedestal is covered by the upper cover. The triggering element is disposed on the pedestal and partially penetrated through the opening. When the triggering element is depressed, the triggering element is moved relative to the pedestal. The spring strip is movably disposed within the sliding groove, and located beside the triggering element. As the triggering element is depressed and moved relative to the pedestal, the spring strip is contacted with the triggering element. Consequently, the spring strip is moved within the sliding groove to collide with the upper cover and a sound is generated.

From the above descriptions, the present invention provides the key structure. The triggering element of the key structure of the present invention can replace the push element and the linkage element of the conventional key structure. Since the triggering element is a one-piece structure, it is not necessary to install a position-limiting structure to limit the movement of the push element and the linkage element. In other words, the triggering element has a reduced thickness. Consequently, the inner space of the key structure can be effectively utilized, or the volume of the key structure is reduced because the inner space is not utilized. The conventional key structure still has some other drawbacks. For example, if the depressing force on the keycap is very small, the moving speed of the linkage element is very slow and thus the linkage element is possibly not collided by the first spring strip. In other words, the conventional key structure has a problem of not generating sound. For solving this problem, the spring strip of the key structure of the present invention is movable within the sliding groove to collide with the upper cover. Alternatively, the key structure of the present invention is equipped with the concave space. Since the spring strip is allowed to be slid within the concave space, the sound can be generated surely. Whenever the keycap of the key structure of the present invention is depressed, the key structure generates sound. Consequently, the user can feel the depressing feedback.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For solving the drawbacks of the conventional technologies, the present invention provides a key structure with reduced volume.

Figure 1:
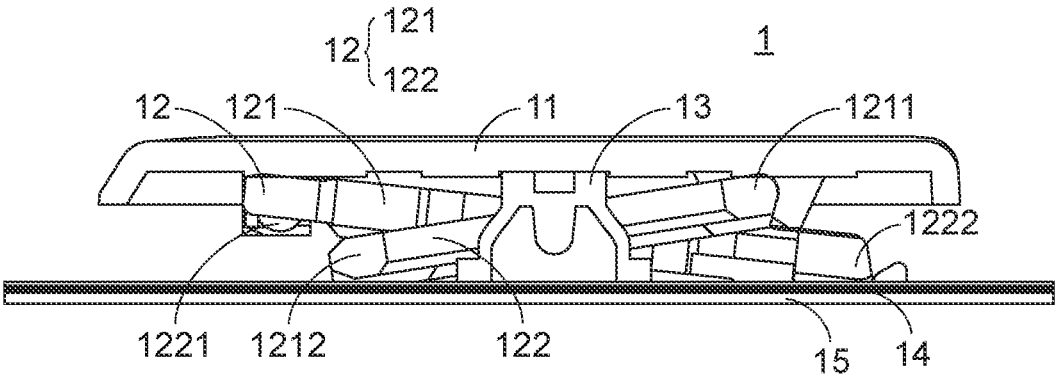
FIG.1 PRIOR ART
FIG. 1 is a schematic side cross-sectional view illustrating a conventional key structure.
Figure 2:
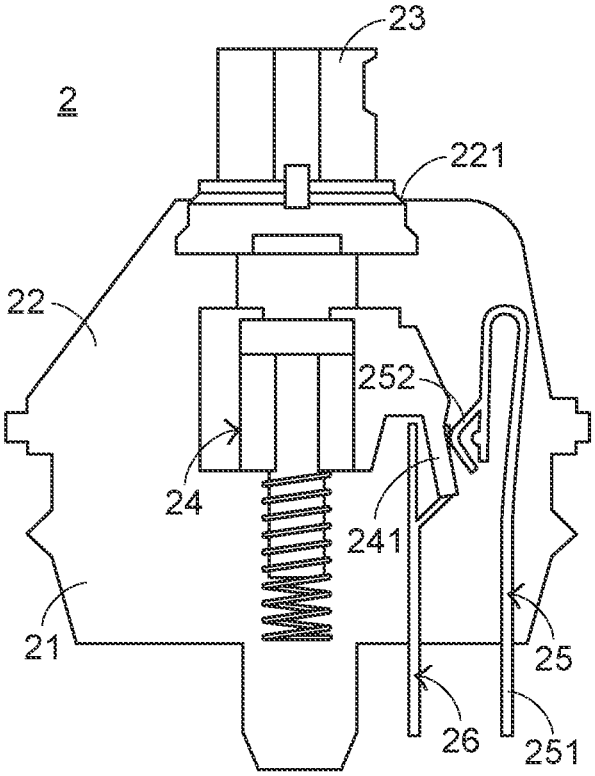
FIG.2 PRIOR ART
FIG. 2 is a schematic exploded view illustrating a conventional mechanical key structure.
Figure 3:
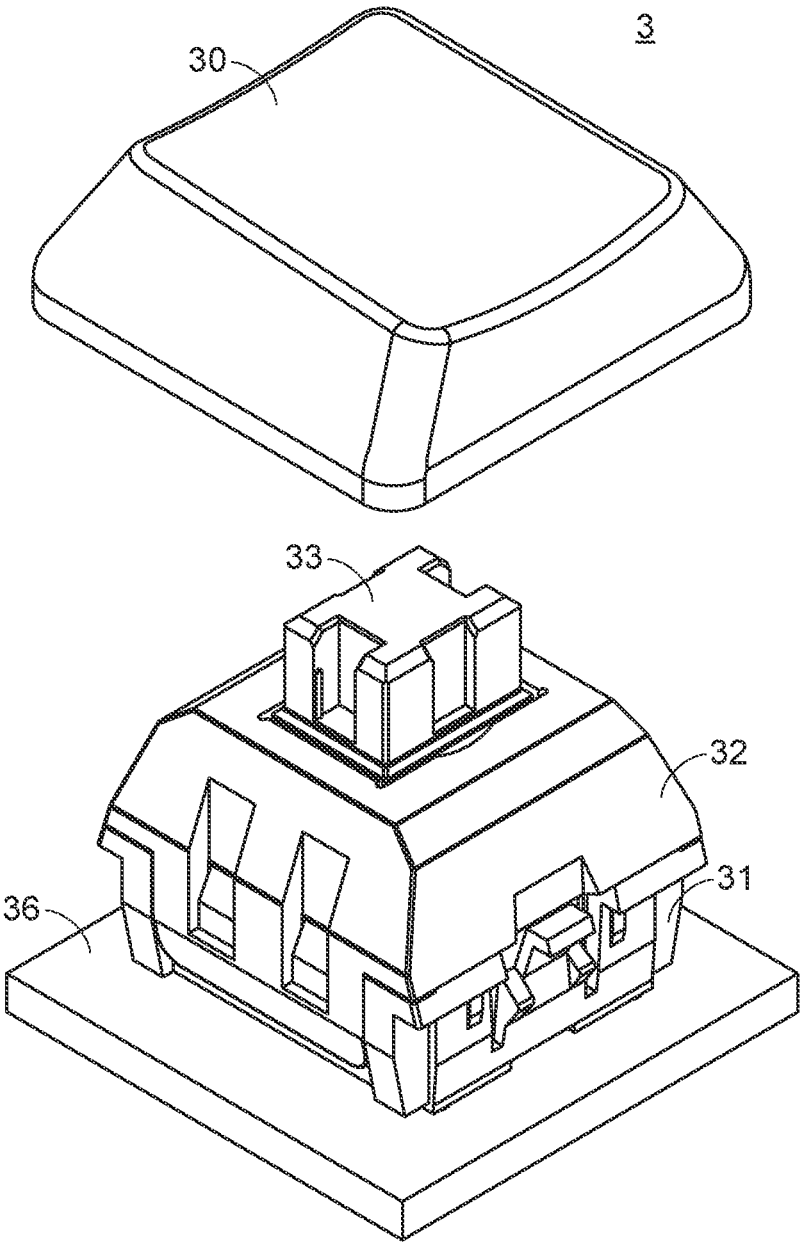
FIG. 3 is a schematic perspective view illustrating a key structure according to a first embodiment of the present invention.
Figure 4:
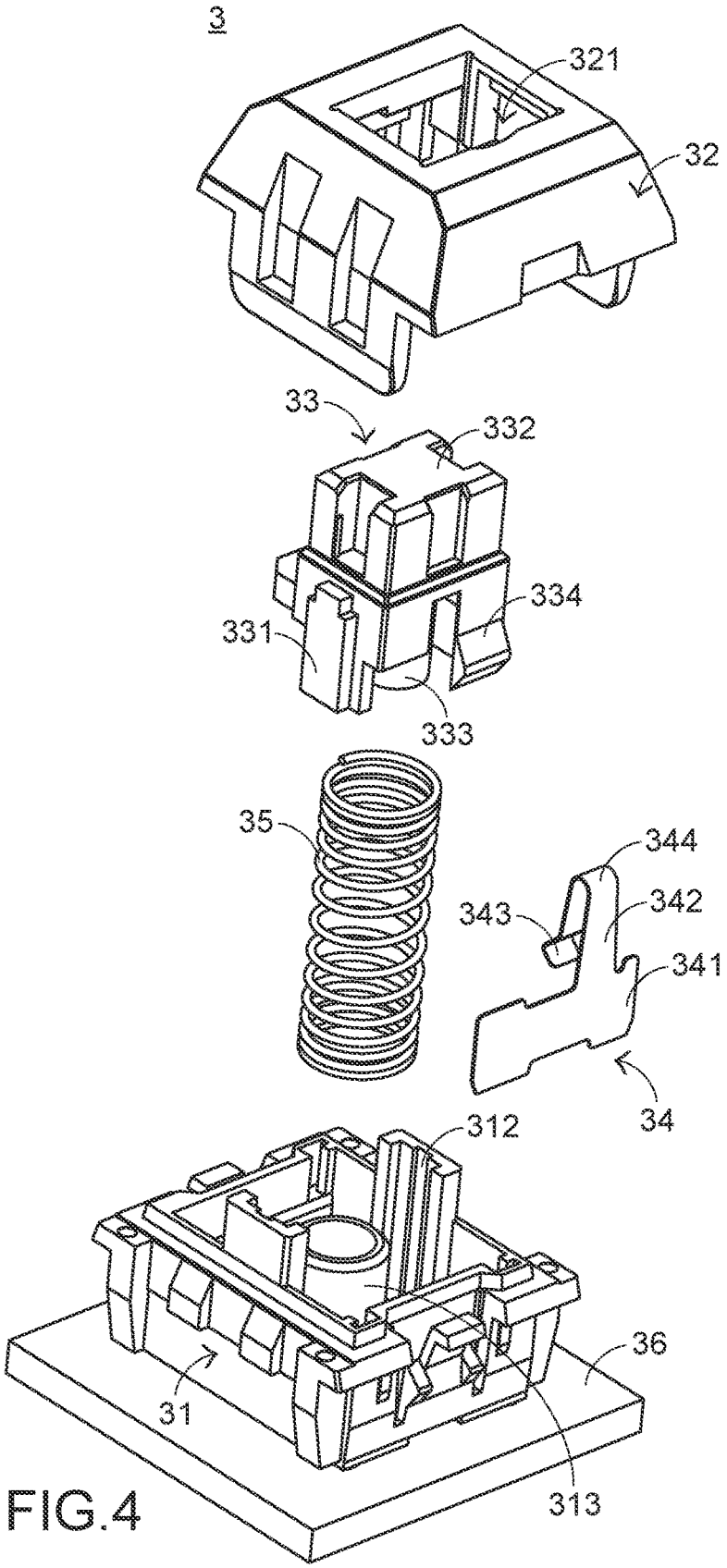
FIG. 4 is a schematic exploded view illustrating the key structure according to the first embodiment of the present invention.

FIG. 3 is a schematic perspective view illustrating a key structure according to a first embodiment of the present invention. FIG. 4 is a schematic exploded view illustrating the key structure according to the first embodiment of the present invention. As shown in FIGS. 3 and 4, the key structure 3 comprises a keycap 30, a pedestal 31, an upper cover 32, a triggering element 33, a spring strip 34, an elastic element 35 and a circuit board 36. The pedestal 31 comprises a sliding groove 311 (see FIG. 5), a receiving recess 312 and a fixing post 313. The receiving recess 312 is located at a middle region of the pedestal 31 for partially accommodating the triggering element 33. The fixing post 313 is disposed within the receiving recess 312 for fixing the elastic element 35 on the pedestal 31. The sliding groove 311 is on a side of the pedestal 31. The spring strip 34 is accommodated within the sliding groove 311. The pedestal 31 is covered by the upper cover 32. Moreover, the upper cover 32 has an opening 321 corresponding to the triggering element 33. The keycap 30 is connected with a first end of the triggering element 33 through the opening 321. Particularly, the triggering element 33 is installed on the pedestal 31, and penetrated through the opening 321 to be connected with the keycap 30. When the triggering element 33 is depressed by the user, the triggering element 33 is moved relative to the pedestal 31. The spring strip 34 is movably disposed within the sliding groove 311. Moreover, the spring strip 34 is located beside the triggering element 33. As the triggering element 33 is moved, the spring strip 34 is contacted with the triggering element 33. The circuit board 36 is disposed under the pedestal 31.

As shown in FIG. 4, the triggering element 33 comprises a main body 331, a first coupling part 332, a second coupling part 333 and a push part 334. The first coupling part 332 is located at a first end of the main body 331 and connected with the keycap 30. The second coupling part 333 is extended externally from the main body 331. After the second coupling part 333 is inserted into the receiving recess 312, the triggering element 33 is partially accommodated within the receiving recess 312. The push part 334 is extended externally from the main body 331. Moreover, the push part 334 is located beside the second coupling part 333. As the triggering element 33 is moved relative to the pedestal 31, the push part 334 is contacted with the spring strip 34 to push the spring strip 34. Moreover, the elastic element 35 is installed on the fixing post 313 within the receiving recess 312 and contacted with the second coupling part 333 of the triggering element 33. The elastic element 35 provides an elastic force. The triggering element 33 is movable in response to an elastic force. In this embodiment, the main body 331, the first coupling part 332, the second coupling part 333 and the push part 334 are integrally formed with the triggering element 33, and made of a plastic material. Moreover, the elastic element 35 is a helical spring.

Figure 5:
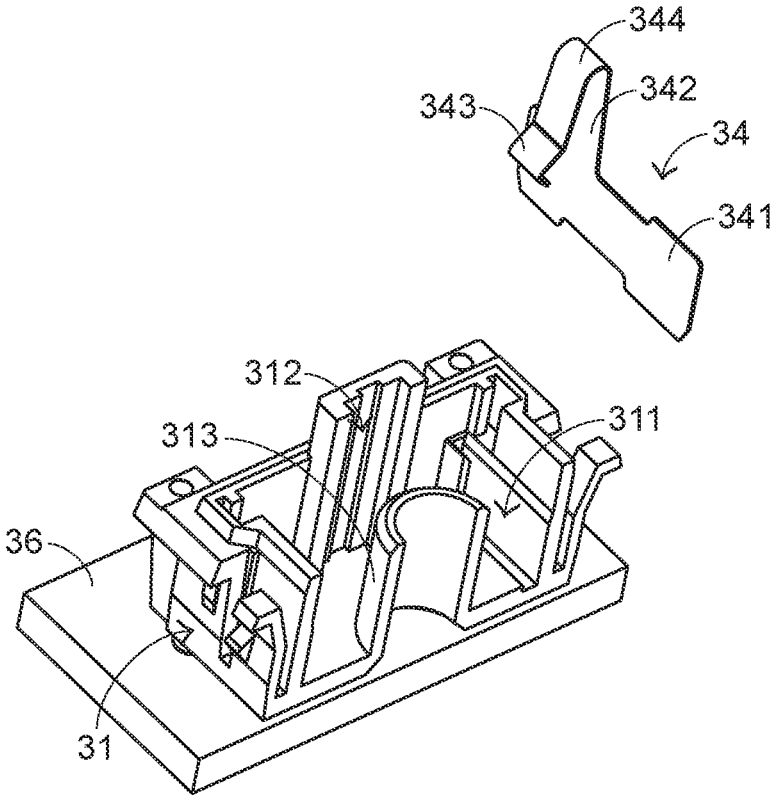
FIG. 5 is a schematic cutaway view illustrating the pedestal of the key structure according to the first embodiment of the present invention.

Hereinafter, the structure of the spring strip 34 will be illustrated with reference to FIGS. 4 and 5. FIG. 5 is a schematic cutaway view illustrating the pedestal of the key structure according to the first embodiment of the present invention. The spring strip 34 comprises a sheet body 341, an extension part 342, a first touch part 343 and a second touch part 344. The sheet body 341 is accommodated within the sliding groove 311 and movable within the sliding groove 311. The extension part 342 is extended externally from the sheet body 341. The first touch part 343 is located at an end of the extension part 342. The first touch part 343 is contactable with the push part 334 of the triggering element 33. The second touch part 344 is disposed on the extension part 342 and contactable with the upper cover 32. In this embodiment, the sheet body 341, the extension part 342, the first touch part 343 and the second touch part 344 are integrally formed with the spring strip 34. Moreover, these components are made of a metallic material.

Figure 6:
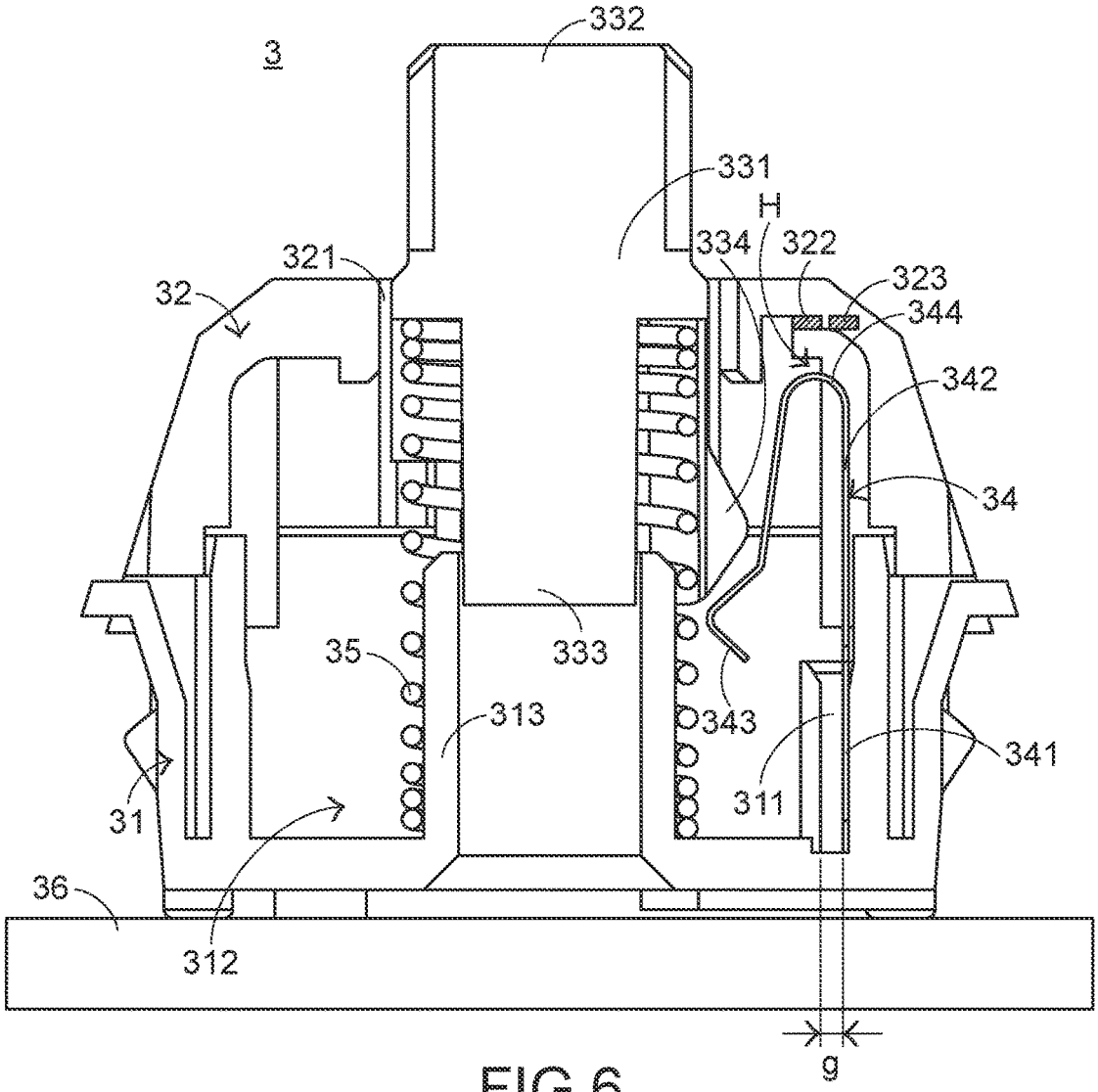
FIG. 6 is a schematic side cutaway view illustrating a portion of the key structure according to the first embodiment of the present invention, in which the keycap is not depressed.

FIG. 6 is a schematic side cutaway view illustrating a portion of the key structure according to the first embodiment of the present invention, in which the keycap is not depressed. In FIG. 6, the combined structure of the pedestal 31, the upper cover 32, the triggering element 33, the spring strip 34, the elastic element 35 and the circuit board 36 is shown. In addition to the opening 321, the upper cover 32 further comprises a first triggering contact 322 and a second triggering contact 323. The first triggering contact 322 is disposed on an inner surface of the upper cover 32, and electrically connected with the circuit board 36. The second triggering contact 323 is disposed on the inner surface of the upper cover 32, and separated from the first triggering contact 322. Also, the second triggering contact 323 is electrically connected with the circuit board 36. For succinctness, the structure for electrically connecting the first triggering contact 322 with the circuit board 36 and the structure for electrically connecting the second triggering contact 323 with the circuit board 36 are not shown. The ways of electrically connecting the first triggering contact 322 and the second triggering contact 323 with the circuit board 36 are well known to those skilled in the art, and are not redundantly described herein. Moreover, the upper cover 32 has a concaved space H. Due to the concaved space H, the movable range of the spring strip 34 within the sliding groove 311 along the vertical direction is increased. That is, the concaved space H can facilitate movement of the spring strip 34 within the sliding groove 311.

Figure 7:
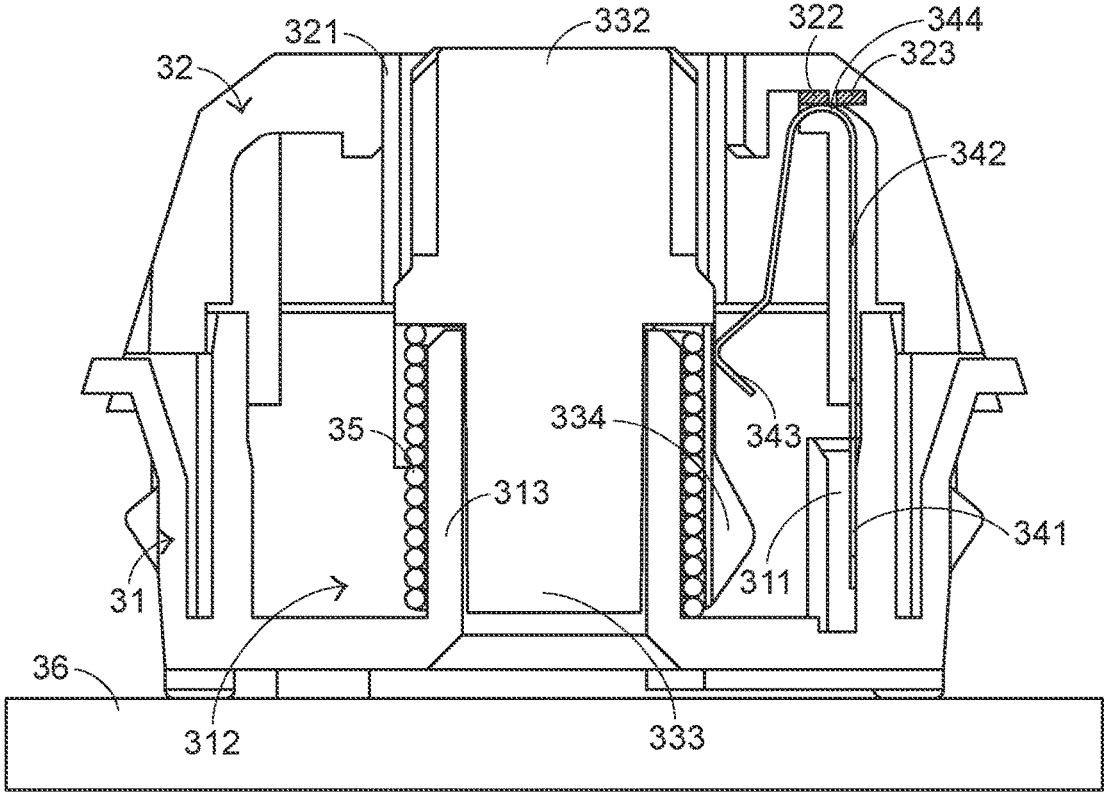
FIG. 7 is a schematic side cutaway view illustrating a portion of the key structure according to the first embodiment of the present invention, in which the keycap is depressed.

The operations of the key structure 3 in response to the depressing action of the user will be illustrated as follows. Please refer to FIGS. 3, 6 and 7. FIG. 7 is a schematic side cutaway view illustrating a portion of the key structure according to the first embodiment of the present invention, in which the keycap is depressed. When the keycap 30 is depressed, the keycap 30 is moved downwardly to push the triggering element 33 in response to the depressing force. As the keycap 30 is moved downwardly relative to the pedestal 31, the triggering element 30 is moved downwardly. While the triggering element 33 is moved downwardly, the elastic element 35 is compressed by the second coupling part 333 of the triggering element 33. Moreover, the push part 334 of the triggering element 33 is contacted with the first touch part 343 of the spring strip 34, and thus the first touch part 343 is pushed by the push part 334. Since the first touch part 343 is pushed by the push part 334 while the push part 334 is moved across the spring strip 34, the spring strip 34 is swung in response to the pushing action on the first touch part 343 and the elasticity of the spring strip 34. Under this circumstance, the sheet body 341 is moved upwardly within the sliding groove 311. When the second touch part 344 of the spring strip 34 collides with the first triggering contact 322 and the second triggering contact 323 of the upper cover 32 (see FIG. 7), a sound is generated.

As mentioned above, the concaved space H allows the spring strip 34 to be moved within the sliding groove 311 along the vertical direction. Consequently, after the push part 334 is contacted with the first touch part 343, the spring strip 34 is swung. In response to the swinging action of the spring strip 34, the second touch part 344 of the spring strip 34 is slid into the concaved space H. Under this circumstance, the first touch part 343 collides with the push part 334 to generate another sound. That is, whenever the push part 334 is moved across the spring strip 34, the key structure 3 generates sound twice.

In the above embodiment, the upper cover 32 of the key structure 3 is equipped with the concaved space H. It is noted that numerous modifications and alterations may be made while retaining the teachings of the invention. For example, in another embodiment, the upper cover is not equipped with the concaved space. However, this design may generate sound twice or not generate sound twice. In case that the push part is moved across the spring strip at a specified speed, the operating principle of this key structure is similar to that of the above key structure to generate sound twice, but the movable range of the spring strip is smaller. Whereas, in case that the push part is moved across the spring strip at a speed slower than the specified speed, the push part is possibly not collided by the first touch part. However, since the upper cover is surely collided by the second touch part 344, at least one sound is generated by the key structure.

When the push part is moved across the spring strip at the specified speed, the push part provides a certain amount of pushing force to the spring strip. The pushing force is at least sufficient for resulting in the swinging action of the first touch part. In other words, the specified speed of the push part is the lowest speed that results in the swinging action of the first touch part.

Please refer to FIG. 7 again. Meanwhile, the second touch part 344 is contacted with the first triggering contact 322 and the second triggering contact 323. Moreover, the first triggering contact 322 and the second triggering contact 323 are electrically connected with each other through the spring strip 34, and thus the circuit board 36 generates a key signal.

When the keycap 30 is no longer depressed by the user, no external force is applied to the keycap 30 and the triggering element 33 is no longer pushed by the keycap 30. In response to the elasticity of the elastic element 35, the compressed elastic element 35 is restored to its original shape to provide an upward elastic restoring force to the second coupling part 333. In response to the upward elastic restoring force, the keycap 30 is returned to its original position where it is not depressed. At the same time, the spring strip 34 is slid downwardly within the sliding groove 311 and returned to its original position corresponding to the non-depressed keycap 30.

More especially, there is a gap g between the spring strip 34 and a sidewall of the sliding groove 311. The size of the gap g is specially designed after calculation. If the size of the gap g is too small, the spring strip 34 is readily jammed in the sliding groove 311. Whereas, if the size of the gap g is too large, the spring strip 34 is only rocked forwardly or backwardly within the sliding groove 311 but fails to be slid upwardly or downwardly within the sliding groove 311. In an embodiment, the size of the gap g is in the range between about 0.05 mm and 0.5 mm. Consequently, the spring strip 34 is allowed to be slid upwardly or downwardly within the sliding groove 311.

Figure 8:
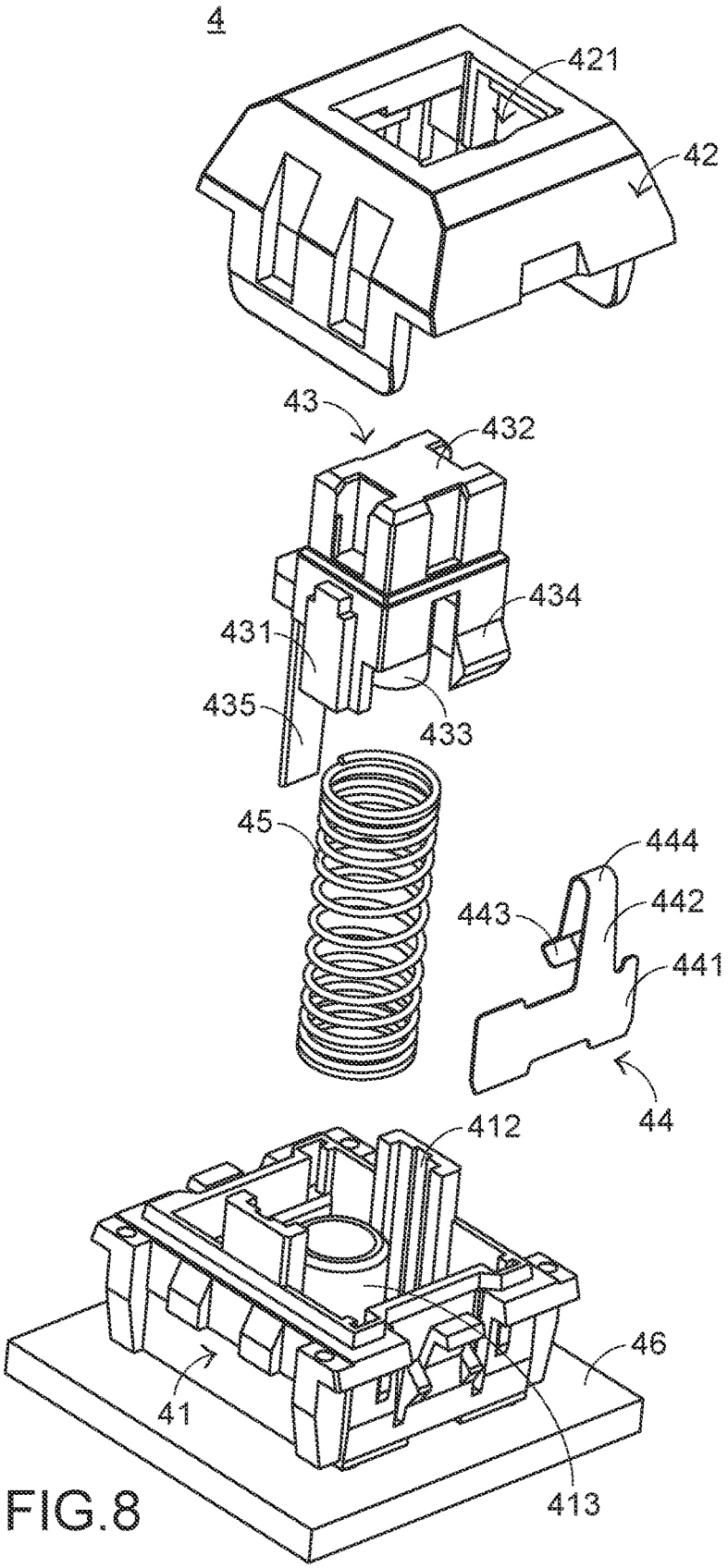
FIG. 8 is a schematic exploded view illustrating a key structure according to a second embodiment of the present invention, in which the keycap is not depressed.
Figure 9:
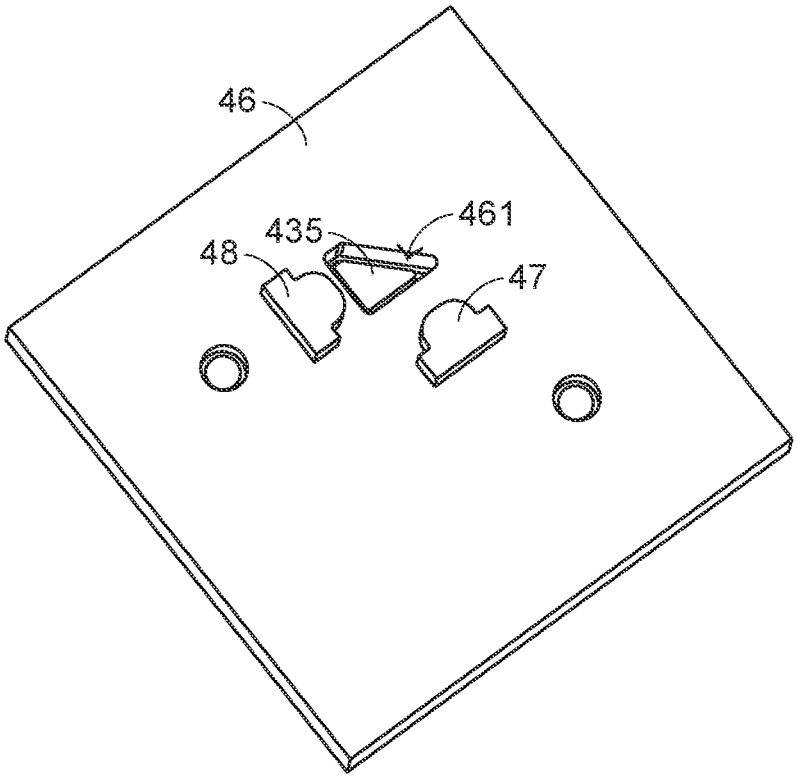
FIG. 9 is a schematic view illustrating the key structure of FIG. 8 and taken along another viewpoint.

The present invention further provides a second embodiment, which is distinguished from the first embodiment. FIG. 8 is a schematic exploded view illustrating a key structure according to a second embodiment of the present invention, in which the keycap is not depressed. FIG. 9 is a schematic view illustrating the key structure of FIG. 8 and taken along another viewpoint. As shown in FIGS. 8 and 9, the key structure 4 comprises a keycap (not shown), a pedestal 41, an upper cover 42, a triggering element 43, a spring strip 44, an elastic element 45, a circuit board 46, a light emitter 47, a light receiver 48 and a light source 49 (see FIG. 10). The pedestal 41 comprises a sliding groove 411 (see FIG. 10), a receiving recess 412 and a fixing post 413. The spring strip 44 comprises a sheet body 441, an extension part 442, a first touch part 443 and a second touch part 444. The structures and functions of the components of the key structure 4 which are identical to those of the first embodiment are not redundantly described herein. In comparison with the first embodiment, the key structure 4 of this embodiment has two distinguished aspects. Firstly, the way of triggering the key structure 4 is distinguished, and some components of the key structure 4 are different. Secondly, the key structure 4 further comprises the light source 49.

As shown in FIG. 8, the triggering element 43 comprises a main body 431, a first coupling part 432, a second coupling part 433, a push part 434 and a light-guiding part 435. The functions of the main body 431, the first coupling part 432, the second coupling part 433 and the push part 434 are identical to those of the first embodiment, and are not redundantly described herein. The light-guiding part 435 is extended externally from the main body 431. Moreover, the light-guiding part 435 is located at another side of the second coupling part 433. In this embodiment, the main body 431, the first coupling part 432, the second coupling part 433, the push part 434 and the light-guiding part 435 are integrally formed with the triggering element 43, and the triggering element 43 is made of a light-transmissible material. Moreover, the structures of the circuit board 46, the light emitter 47 and the light receiver 48 are shown in FIG. 9. The circuit board 46 has a perforation 461. The perforation 461 runs through the circuit board 46. The light emitter 47 is disposed on a bottom surface of the circuit board 46. The light emitter 47 emits a first light beam B1 (see FIG. 11). The light receiver 48 is disposed on the bottom surface of the circuit board 46, and located beside the light emitter 47. When the first light beam B1 is received by the light receiver 48, the circuit board 46 generates a key signal.

Figure 10:
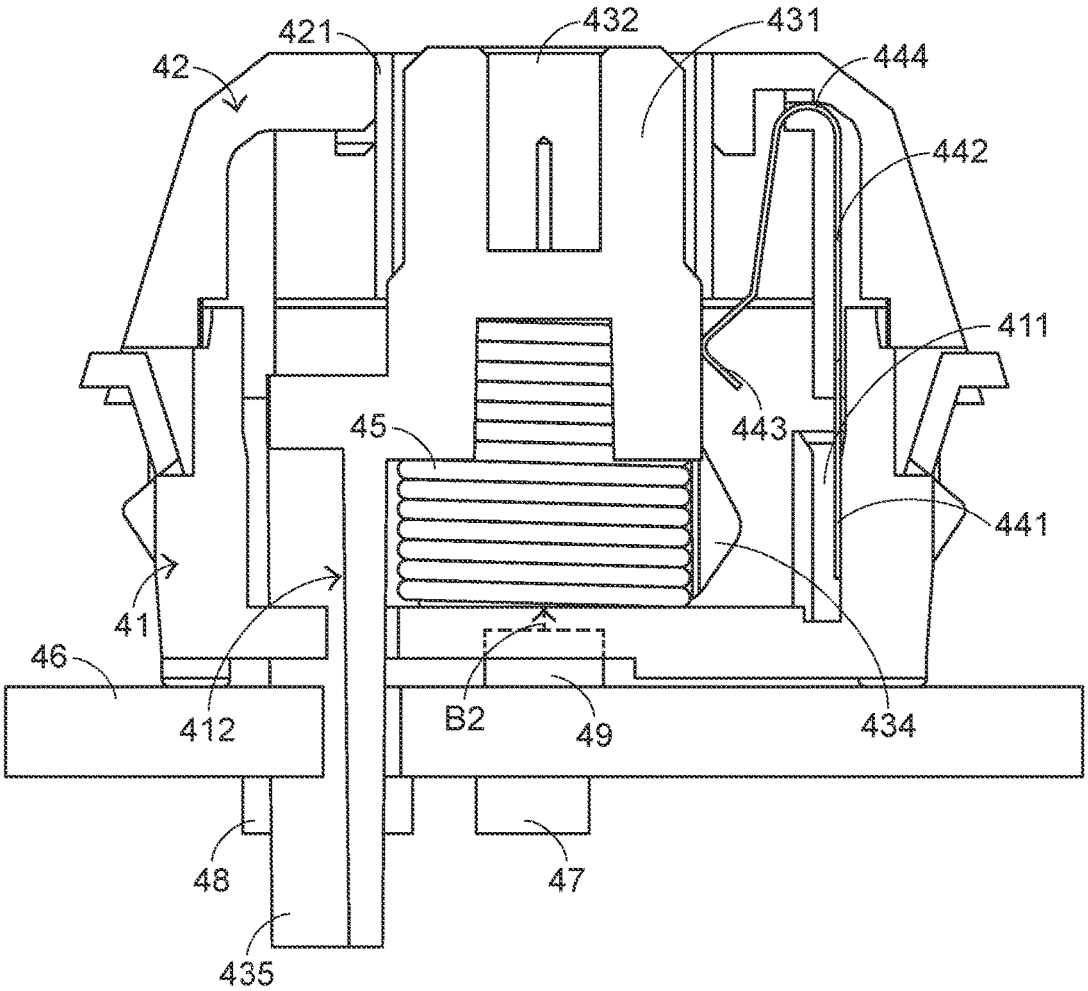
FIG. 10 is a schematic side cutaway view illustrating a portion of the key structure according to the second embodiment of the present invention, in which the keycap is depressed.
Figure 11:
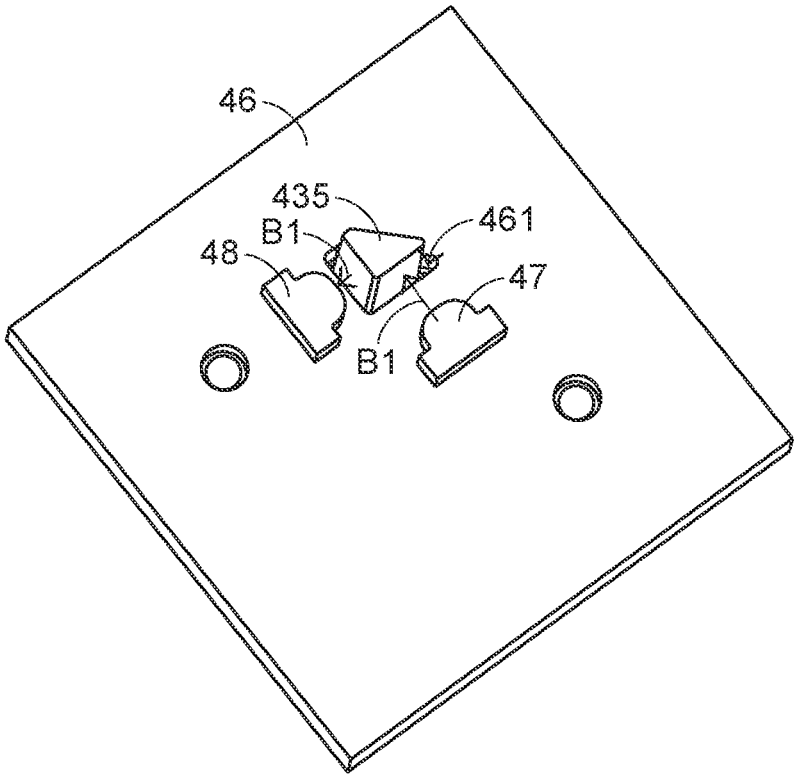
FIG. 11 is a schematic view illustrating the key structure of FIG. 10 and taken along another viewpoint.

The operations of the conventional key structure 4 in response to the depressing action of the user will be illustrated as follows. Please refer to FIGS. 8, 9, 10 and 11. FIG. 10 is a schematic side cutaway view illustrating a portion of the key structure according to the second embodiment of the present invention, in which the keycap is depressed. FIG. 11 is a schematic view illustrating the key structure of FIG. 10 and taken along another viewpoint. When the keycap is depressed, the keycap is moved downwardly to push the triggering element in response to the depressing force. As the keycap is moved downwardly relative to the pedestal 41, the triggering element 43 is moved downwardly. While the triggering element 43 is moved downwardly, the elastic element 45 is compressed by the second coupling part 433 of the triggering element 43. Moreover, the push part 434 of the triggering element 43 is contacted with the first touch part 443 of the spring strip 44, and thus the first touch part 443 is pushed by the push part 434. Since the first touch part 443 is pushed by the push part 434 while the push part 434 is moved across the spring strip 44, the spring strip 44 is swung in response to the pushing action on the first touch part 443 and the elasticity of the spring strip 44. Under this circumstance, the sheet body 441 is moved upwardly within the sliding groove 411. When the second touch part 444 of the spring strip 44 collides with the upper cover 42 (see FIG. 10), a sound is generated.

Please refer to FIG. 11. As the push part 434 is moved downwardly, the light-guiding part 435 is partially penetrated through the perforation 461 of the circuit board 461 and located at the region between the light emitter 47 and the light receiver 48. Consequently, the first light beam B1 from the light emitter 47 is introduced into the light-guiding part 435, and the first light beam B1 is guided to the light receiver 48 by the light-guiding part 435. After the first light beam B1 is received by the light receiver 48, the circuit board 46 generates a corresponding key signal.

When the keycap is no longer depressed by the user, no external force is applied to the keycap and the triggering element 43 is no longer pushed by the keycap. In response to the elasticity of the elastic element 45, the compressed elastic element 45 is restored to its original shape to provide an upward elastic restoring force to the second coupling part 433. In response to the upward elastic restoring force, the triggering element 43 along with the light-guiding part 435 is returned to its original position, and the keycap is returned to its original position where it is not depressed. At the same time, the spring strip 44 is slid downwardly within the sliding groove 411 and returned to its original position corresponding to the non-depressed keycap.

Please refer to FIG. 10 again. The light source 49 is disposed on a top surface of the circuit board 46. The light source 49 emits a second light beam B2. The second light beam B2 is transmitted through the triggering element 43, which is made of the light-transmissible material. Consequently, the key structure 4 has an illuminating function. Preferably but not exclusively, the light source 49 is a light emitting diode.

It is noted that numerous modifications and alterations may be made while retaining the teachings of the invention. For example, in another embodiment, the key structure is not equipped with the light source. Consequently, in the triggering element, only the light-guiding part is made of the light-guiding material but the other structures are not made of the light-guiding material.

In this embodiment, the circuit board 46 of the key structure 4 is triggered according to an optical triggering method. Consequently, it is not necessary to install the first triggering contact and the second triggering contact on the inner surface of the upper cover 42.

From the above descriptions, the present invention provides the key structure. The triggering element of the key structure of the present invention can replace the push element and the linkage element of the conventional key structure. Since the triggering element is a one-piece structure, it is not necessary to install a position-limiting structure to limit the movement of the push element and the linkage element. In other words, the triggering element has a reduced thickness. Consequently, the inner space of the key structure can be effectively utilized, or the volume of the key structure is reduced because the inner space is not utilized. The conventional key structure still has some other drawbacks. For example, if the depressing force on the keycap is very small, the moving speed of the linkage element is very slow and thus the linkage element is possibly not collided by the first spring strip. In other words, the conventional key structure has a problem of not generating sound. For solving this problem, the spring strip of the key structure of the present invention is movable within the sliding groove to collide with the upper cover. Alternatively, the key structure of the present invention is equipped with the concave space. Since the spring strip is allowed to be slid within the concave space, the sound can be generated surely. Whenever the keycap of the key structure of the present invention is depressed, the key structure generates sound. Consequently, the user can feel the depressing feedback.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a pedestal comprising a sliding groove;

an upper cover having an opening, wherein the pedestal is covered by the upper cover;

a triggering element disposed on the pedestal and partially penetrated through the opening, wherein when the triggering element is depressed, the triggering element is moved relative to the pedestal;

a spring strip movably disposed within the sliding groove, and located beside the triggering element, wherein as the triggering element is depressed and moved relative to the pedestal, the spring strip is contacted with the triggering element, so that the spring strip is moved within the sliding groove to collide with the upper cover and a sound is generated; and a circuit board, wherein the circuit board is disposed under the pedestal, and the upper cover comprises;

a first triggering contact disposed on an inner surface of the upper cover and electrically connected with the circuit board; and a second triggering contact disposed on the inner surface of the upper cover, separated from the first triggering contact, and electrically connected with the circuit board, wherein when the spring strip is contacted with the first triggering contact and the second triggering contact, the first triggering contact and the second triggering contact are electrically connected with each other through the spring strip, so that the circuit board generates a key signal.

2. The key structure according to claim 1, wherein the pedestal further comprises a receiving recess at a middle region of the pedestal, wherein the triggering element is partially accommodated within the receiving recess, so that the triggering element is movable relative to the pedestal.

3. The key structure according to claim 2, wherein the triggering element comprises:

a main body;

a first coupling part located at a first end of the main body and connected with a keycap;

a second coupling part extended externally from the main body and inserted into the receiving recess; and a push part extended externally from the main body and located beside the second coupling part, wherein as the triggering element is moved relative to the pedestal, the spring strip is pushed by the push part.

4. The key structure according to claim 3, wherein the main body, the first coupling part, the second coupling part and the push part are integrally formed with the triggering element.

5. The key structure according to claim 2, further comprising an elastic element, wherein the elastic element is installed within the receiving recess and contacted with the triggering element, wherein in response to an elastic force provided by the elastic element, the triggering element is returned to an original position.

6. The key structure according to claim 1, wherein the spring strip comprises:

a sheet body accommodated within the sliding groove and movable within the sliding groove;

an extension part extended externally from the sheet body;

a first touch part located at an end of the extension part, wherein the first touch part is contactable with the triggering element; and a second touch part disposed on the extension part and contactable with the upper cover, wherein when the triggering element is contacted with the first touch part, the sheet body is moved within the sliding groove and the second touch part is contacted with the upper cover to generate the sound.

7. The key structure according to claim 1, further comprising:

a circuit board having a perforation, wherein the perforation runs through the circuit board;

a light emitter disposed on a bottom surface of the circuit board, and emitting a light beam; and a light receiver disposed on the bottom surface of the circuit board, and located beside the light emitter, wherein when the light beam is received by the light receiver, the circuit board generates a key signal.

8. The key structure according to claim 7, wherein the triggering element comprises:

a main body;

a first coupling part located at a first end of the main body and connected with a keycap;

a second coupling part extended externally from the main body and inserted into the receiving recess;

a push part extended externally from the main body and located beside a first side of the second coupling part, wherein as the triggering element is moved relative to the pedestal, the spring strip is pushed by the push part; and a light-guiding part extended externally from the main body, and located beside a second side of the second coupling part, wherein when the triggering element is moved relative to the pedestal to a region between the light emitter and the light receiver, the light beam is introduced into the light-guiding part.

9. The key structure according to claim 8, wherein the main body, the first coupling part, the second coupling part, the push part and the light-guiding part are integrally formed with the triggering element, and the triggering element is made of a light-transmissible material.

10. The key structure according to claim 1, wherein there is a gap between the spring strip and a sidewall of the sliding groove, and a size of the gap is in a range between about 0.05 mm and 0.5 mm.

11. The key structure according to claim 1, wherein the upper cover further comprises a concaved space, and the spring strip within the sliding groove is allowed to be moved into the concaved space.

12. A key structure comprising:

a pedestal comprising a sliding groove;

an upper cover having an opening, wherein the pedestal is covered by the upper cover;

a triggering element disposed on the pedestal and partially penetrated through the opening, wherein when the triggering element is depressed, the triggering element is moved relative to the pedestal; and a spring strip movably disposed within the sliding groove, and located beside the triggering element, wherein as the triggering element is depressed and moved relative to the pedestal, the spring strip is contacted with the triggering element, so that the spring strip is moved within the sliding groove to collide with the upper cover and a sound is generated, wherein the spring strip comprises:

a sheet body accommodated within the sliding groove and movable within the sliding groove;

an extension part extended externally from the sheet body;

a first touch part located at an end of the extension part, wherein the first touch part is contactable with the triggering element; and a second touch part disposed on the extension part and contactable with the upper cover, wherein when the triggering element is contacted with the first touch part, the sheet body is moved within the sliding groove and the second touch part is contacted with the upper cover to generate the sound.

* * * * *